US005375628A

United States Patent [19]

Hacker

[11] Patent Number: 5,375,628

[45] Date of Patent: Dec. 27, 1994

[54] ADJUSTABLE HARNESS GUIDE FOR THE JACQUARD MACHINE OF A SEAM-WEAVING MACHINE

[75] Inventor: Hans E. Hacker, Reutlingen, Germany

[73] Assignee: Novatech GmbH Siebe und Technologie fur Papier, Reutlingen, Germany

[21] Appl. No.: 149,957

[22] Filed: Nov. 10, 1993

[30] Foreign Application Priority Data

Nov. 12, 1992 [DE] Germany ..... 9215440[U]

[51] Int. Cl.[5] ..... D03C 3/38; D03C 3/10

[52] U.S. Cl. ..... 139/86; 139/383 AA

[58] Field of Search ..... 139/86, 85, 383 AA

[56] References Cited

U.S. PATENT DOCUMENTS

| | | | |
|---|---|---|---|
| 574,382 | 1/1897 | Brauch | 139/86 |
| 4,581,794 | 4/1986 | Oldroyd et al. . | |

FOREIGN PATENT DOCUMENTS

| | | | |
|---|---|---|---|
| 0236601 | 9/1987 | European Pat. Off. . | |
| 2135883 | 11/1972 | France | 139/86 |
| 104340 | 12/1898 | Germany . | |
| 140500 | 6/1902 | Germany . | |
| 160007 | 5/1903 | Germany . | |
| 6948426 | 12/1939 | Germany . | |
| 2828140 | 1/1980 | Germany . | |
| 595641 | 7/1959 | Italy | 139/86 |
| 207438 | 8/1989 | Japan | 139/86 |
| 4136228 | 5/1992 | Japan | 139/86 |
| 1209589 | 10/1970 | United Kingdom . | |

*Primary Examiner*—Andrew M. Falik

*Attorney, Agent, or Firm*—Sughrue, Mion, Zinn, Macpeak & Seas

[57] ABSTRACT

An adjustable harness guide for the Jacquard machine of a seam-weaving machine in which the harness cords are drawn back by tension springs which are secured in a grille. The harness cords are guided through a harness board and the weaving shed is located between the grille and the harness board. The grille and the harness board are adjustable in their angle position relative to the course of the harness cords. The grille and the harness board are connected by a rod linkage system so that they move synchronously. The grille and the harness board are each formed of two halves connected to each other by a hinge with the axis of the hinge running parallel to the warp threads of the seam-weaving shed.

4 Claims, 3 Drawing Sheets

ADJUSTABLE HARNESS GUIDE FOR THE JACQUARD MACHINE OF A SEAM-WEAVING MACHINE

BACKGROUND OF THE INVENTION

The invention relates to an adjustable harness guide for the Jacquard machine of a seam-weaving machine, in which the harness cords are guided through a harness board and drawn back by tension springs which are secured in a tension spring grille. The weaving shed is located between the tension spring grille and the harness board.

A harness guide of this design and for this purpose is described in U.S. Pat. No. 4,581,794 granted Apr. 15, 1986. Here, the tension spring grille is arranged horizontally as is the harness board. For weaving sheds of different thread densities, it is advantageous in each case to use tension spring grilles and harness boards matched to the thread density.

DE-C-160 007 discloses a Jacquard machine in which the comber boards are arranged in zig-zag formation and foldable together in the manner of lazy tongs, so that a matching of the width of the comber board to the product width is possible. In this case the Jacquard machine is of the design which is arranged above the weaving shed and in which the harness cords are drawn downwardly by weights.

SUMMARY OF THE INVENTION

The object of the invention is to provide a guide for the harness cords of a Jacquard machine of a seam-weaving machine which can be matched in a simple manner to the thread density of the woven seam. Accordingly, one of the objects of the present invention is to solve the above conventional drawbacks.

This object is achieved according to the invention in that the tension spring grille and the harness board are adjustable in an alterable angle relative to the harness cords. Since the tension spring grille and the harness board are adjustable, their effective width can be matched in a simple manner to the thread density of the woven seam. In this case the effective width is the apparent width of the tension spring grille and of the harness board seen in the direction parallel to the harness cords.

For preference, the tension spring grille and the harness board are divided into two parts connected by a hinge. In this way the change in length to be compensated for by the tension springs becomes smaller. The tension spring grille and the harness board are preferably connected to each other in such a way that their adjustment takes place synchronously.

The tension springs are preferably elastic cords. Compared with conventional tension springs in the form of coiled springs, these have the advantage that the auxiliary warp threads cannot become hooked up in elastic cords. Particularly in the case of a high thread density, there is a danger with coiled springs that the crimped auxiliary warp threads will become hooked up in the coiled springs. The auxiliary warp threads are crimped, as they are usually removed from the woven fabric after the thermosetting.

The adjustable harness guide according to the invention is particularly suitable for the arrangement of a Jacquard machine according to the simultaneously filed U.S. patent application Ser. No. 08/149,726 entitled "Seam-weaving machine for the production of a continuous plastics woven fabric with a Jacquard machine arranged underneath the weaving shed".

An embodiment of the invention is explained below with reference to the drawings.

DETAILED DESCRIPTION OF THE INVENTION

Figure 5:
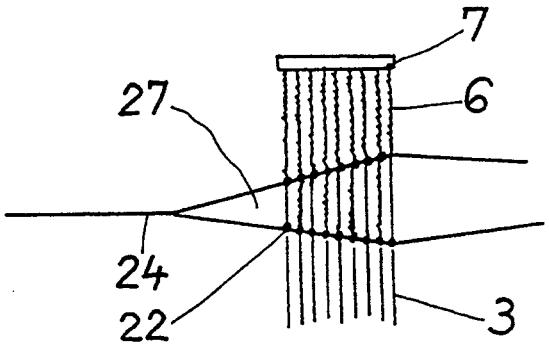
FIG. 5 is a side elevational view of the seam-weaving shed.
Figure 1:
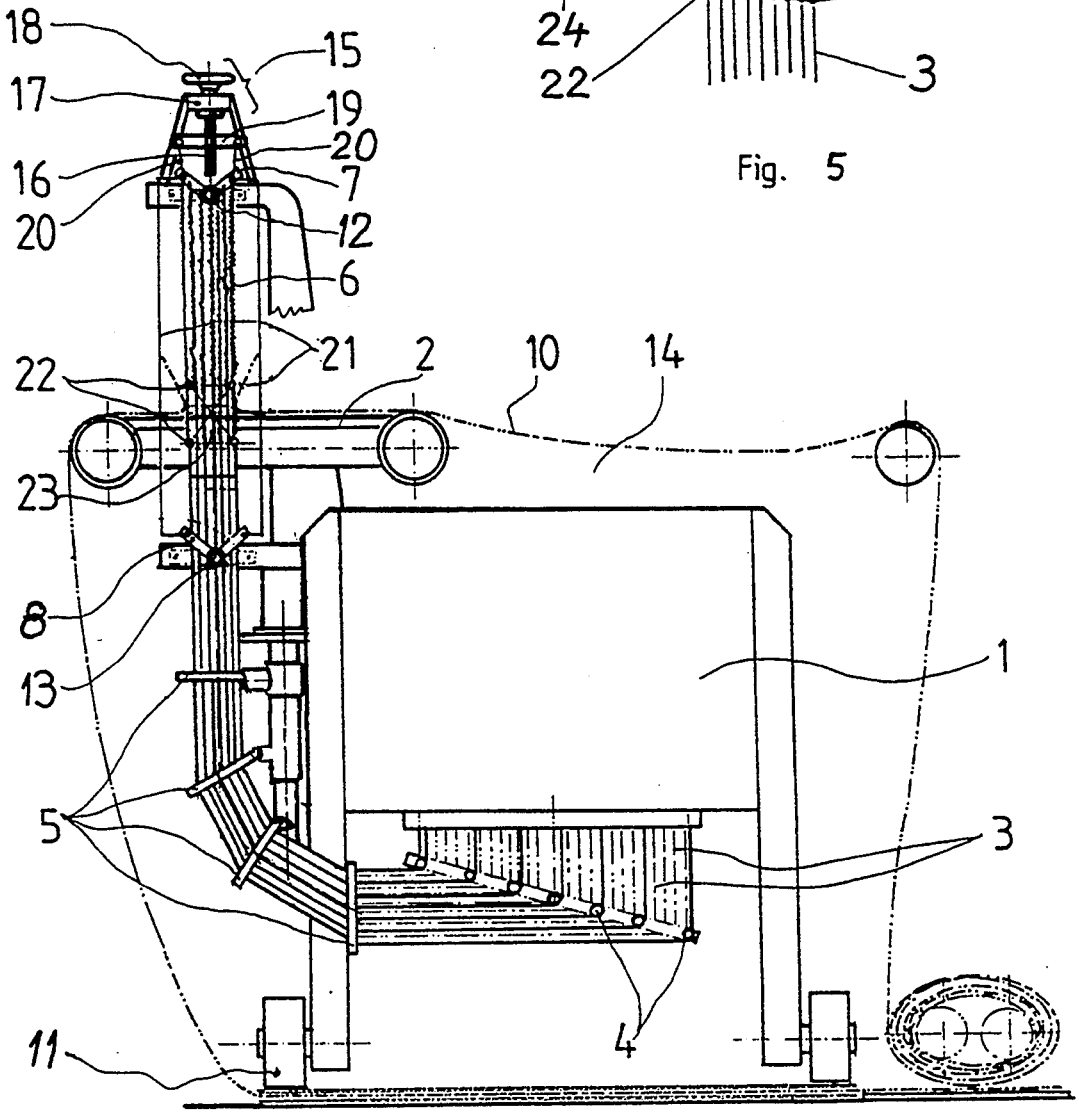
FIG. 1 is a front elevational view of a seam weaving machine, partly in section, showing the Jacquard machine with the seam-weaving machine.
Figure 2:
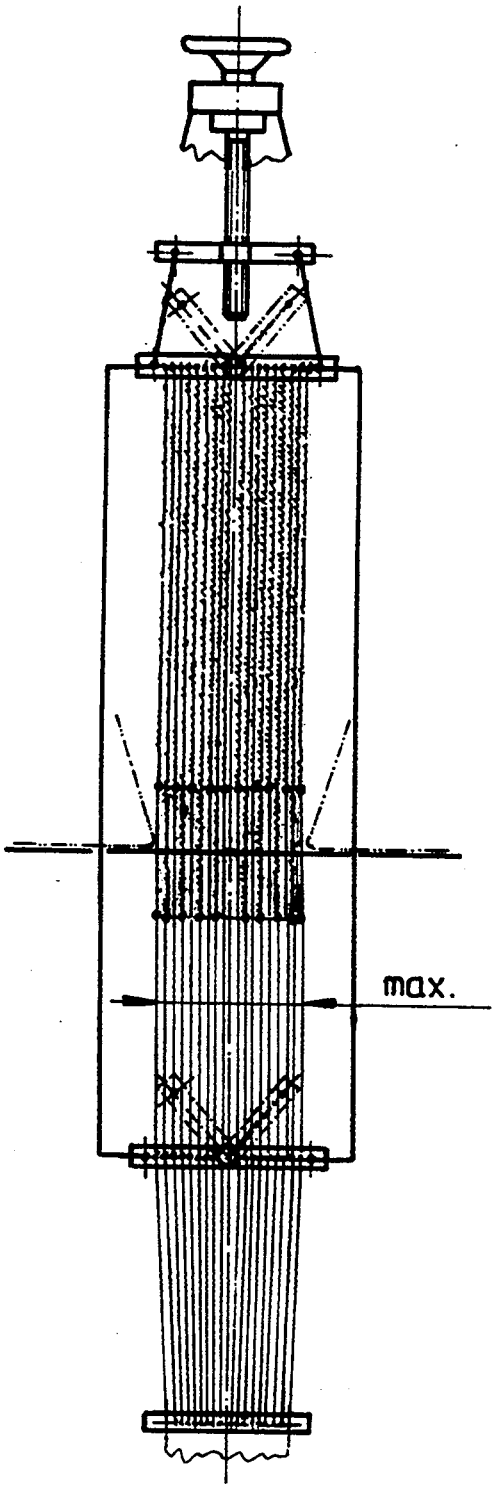
FIG. 2 is a side elevational view of the harness guide at maximum harness width.
Figure 3:
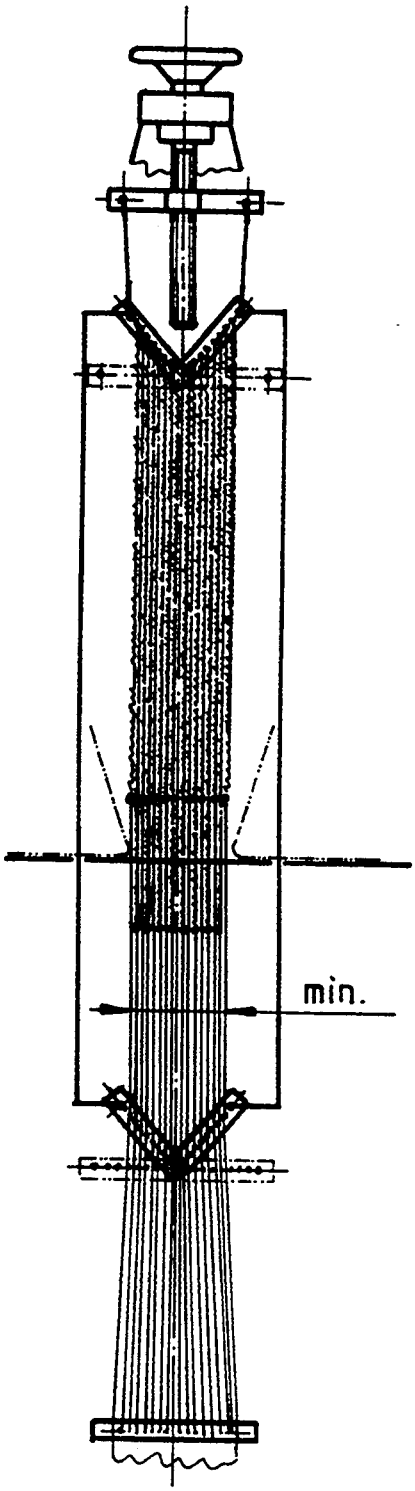
FIG. 3 is a side elevational view of the harness guide at minimum harness width.

FIG. 1 provides an overview of the arrangement of a Jacquard machine with a seam-weaving machine. This Jacquard machine is a standard commercial mass-produced model with an electronically controlled double-lift open-shed Jacquard machine. The Jacquard machine 1 is installed in the normal position, i.e. with harness cords 3 emerging on the underside below the working or fabric plane 2. Deflecting rollers 4 deflect the harness cords 3 by 90° into the horizontal plane. The harness cords 3 are then deflected vertically upwards out of the horizontal plane stepwise through several comber boards 5 which are offset at an angle relative to each other. The design of the deflection apparatus is random in itself. For reasons of space, offset comber boards are used here for the second 90° deflection. The harness cords 3 are then guided through a harness board 8 to eyelets 22 which are located in the woven fabric plane 2. The eyelets 22 are suspended from a grille 7 by tension springs 6 in the form of Lycra counter-pulls or elastic cords.

Figure 4:
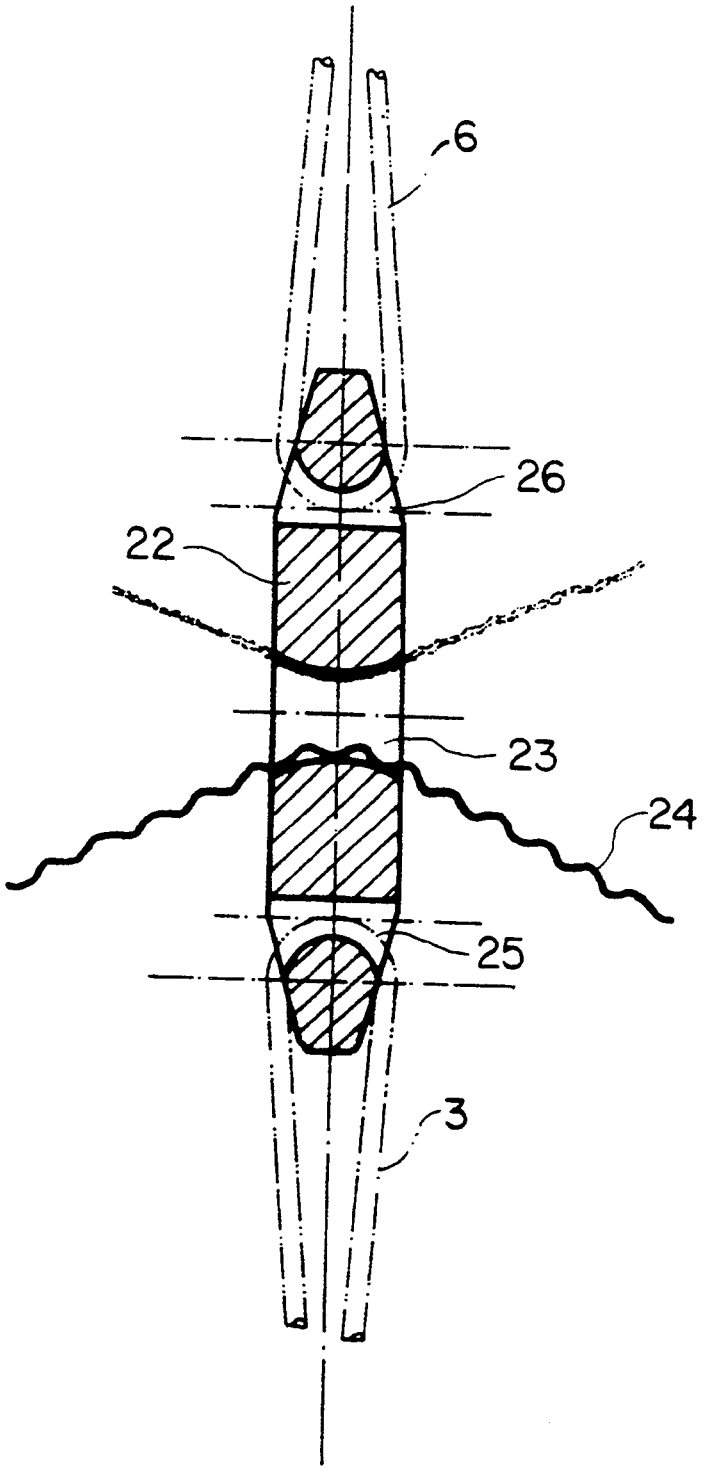
FIG. 4 is a vertical sectional view of an eyelet.

According to FIG. 4, the eyelets 22 have in the center an opening 23 through which the crimped auxiliary warp threads 24 pass. At the lower and upper ends the eyelet 22 also has apertures 25, 26 through which the harness cord 3 and the Lycra counter-pull 6 are guided, respectively. The eyelets 22 are so designed that the opening 23 has as great as possible a radius in auxiliary warp direction on both sides for the introduction of the auxiliary warp threads 24. As the auxiliary warp threads 24 are removed from the woven fabric which is to be joined by means of the woven seam, they are crimped and could therefore become hooked up in the opening 23 if the latter has edges with too small a radius. Because the edges of the opening 23 are rounded with a large radius, an auxiliary warp thread tension reproducible to a high degree is guaranteed at the fell, which is of advantage for a continuous, low-disruption seam-weaving process.

A tunnel 14 is formed in known manner from the woven fabric 10 which is to be made continuous and the Jacquard machine 1 is moved along on rollers 11, according to the progress of the woven seam inside the tunnel.

In order to be able to match the distance between the harness cords to the distance between the warp threads in the seam-weaving shed 27, the grille 7 and the harness board 8 are designed tiltable vis-a-vis the direction of the harness cords 3, i.e. movable in the plane of the harness cords. In the embodiment, the grille 7 and the harness board 8 are designed foldable in the middle, so that they consist of two halves pivotally connected by a hinge 12, 13, respectively. The axes of the hinges 12, 13 run in the direction of the auxiliary warp threads of the seam-weaving shed. Through upward swivelling of the two halves of the harness board 8 and in the same way of the tension spring grille 7, the effective width of the harness board 8 and of the tension spring grille 7, i.e. their projection onto the woven fabric plane 2, becomes narrower and the harness cords 3 move closer together.

Provided above the tension spring grille 7 is an adjustment apparatus 15 which has a threaded spindle 16 which is housed rotatable in a bearing block 17 connected to the frame of the seam-weaving machine and is rotatable by means of a hand wheel 18. The threaded spindle 16 moves a cross-bar 19, which for its part engages via links 20 at the lateral ends of the two halves of the tension spring grille 7. Through rotation of the hand wheel 18, the grille 7 can thus be moved from an open position in which the two halves lie in a plane into a more or less folded position in which the two halves of the grille 7 stand at an adjustable angle relative to each other and to the direction of the harness cords 3. The movement of the grille 7 is transmitted via a rod linkage system 21 to the harness board 8, so that the latter opens or folds in the same way as the grille 7. In this way it is ensured that the harness cords run parallel between the grille 7 and the harness board 8.

In the open position of the grille 7 and of the harness board 8, the harness width is at its maximum and the density of the warp threads at its minimum, e.g. 42 warp threads per cm. Through swivelling of the two halves of the tension spring grille 7 and of the harness board 8 by up to about 50° in each case, the harness width can be reduced to about 60%, which then corresponds to a warp thread density of 70/cm̄. Intermediate values are of course also possible.

While the invention has been particularly shown and described with reference to preferred embodiments thereof, it will be understood by those in the art that the foregoing and other changes in form and details may be made therein without departing from the spirit and scope of the invention.

What is claimed is:

1. An adjustable harness guide for a Jacquard machine of a seam-weaving machine having a harness comprised of a plurality of harness cords, said adjustable harness guide comprising an adjustable grille adapted to be mounted on said seam weaving machine for adjusting harness width, a plurality of tension spring means connected to said grille for connection to respective harness cords, an adjustable harness board adapted to be mounted on said weaving machine for guiding said harness cords along a course to said spring means and adjusting means for adjusting said grille and said harness board angularly relative to the course of said harness cords.

2. An adjustable harness guide according to claim 1, wherein said adjusting means includes linkage means interconnecting said grille and said harness board for synchronous movement.

3. An adjustable harness guide according to claim 1, wherein the grille and the harness board are each comprised of two halves pivotally connected to each other by a hinge having an axis adapted to extend parallel to warp threads of a seam-weaving shed.

4. An adjustable harness guide according to claim 1, wherein said tension spring means are elastic cords.

* * * * *